US008898835B2

(12) United States Patent
Khan

(10) Patent No.: US 8,898,835 B2
(45) Date of Patent: Dec. 2, 2014

(54) FITTED BLANKET WITH OPENING AND CLOSING MECHANISM

(71) Applicant: Amer Habib Khan, Streamwood, IL (US)

(72) Inventor: Amer Habib Khan, Streamwood, IL (US)

( * ) Notice: Subject to any disclaimer, the term of this patent is extended or adjusted under 35 U.S.C. 154(b) by 82 days.

(21) Appl. No.: 13/753,468

(22) Filed: Jan. 29, 2013

(65) Prior Publication Data

US 2013/0198956 A1 Aug. 8, 2013

Related U.S. Application Data

(60) Provisional application No. 61/596,114, filed on Feb. 7, 2012.

(51) Int. Cl.
*A47G 9/02* (2006.01)
*A47G 9/04* (2006.01)

(52) U.S. Cl.
CPC ..... *A47G 9/04* (2013.01); *A47G 9/0223* (2013.01)
USPC ..... 5/498; 5/482; 5/495; 5/502; 5/497

(58) Field of Classification Search
USPC ..... 5/498, 497, 484, 499, 48, 482, 495, 5/413 R, 655, 502, 923
See application file for complete search history.

(56) References Cited

U.S. PATENT DOCUMENTS

| | | | | | |
|---|---|---|---|---|---|
| 1,964,271 | A * | 6/1934 | O'Dwyer | 5/494 |
| 4,413,368 | A * | 11/1983 | Schuetze | 5/494 |
| D384,188 | S * | 9/1997 | Imm | D2/719 |
| D395,372 | S * | 6/1998 | Simpson | D6/611 |
| 6,088,852 | A * | 7/2000 | Quandt | 5/482 |
| 6,640,362 | B1 * | 11/2003 | Kimball | 5/482 |
| D562,612 | S * | 2/2008 | Simpson et al. | D6/611 |
| 7,832,032 | B2 * | 11/2010 | Haislip | 5/413 R |
| 8,756,730 | B2 | 6/2014 | MacDonald | |
| 2004/0031100 | A1 * | 2/2004 | Creech | 5/497 |
| 2009/0056017 | A1 * | 3/2009 | Jones et al. | 5/485 |
| 2009/0293195 | A1 * | 12/2009 | McGrath et al. | 5/484 |

* cited by examiner

*Primary Examiner* — Peter M Cuomo
*Assistant Examiner* — Brittany Wilson

(57) ABSTRACT

A fitted blanket fits over a mattress and secures underneath to prevent the blanket from moving off the user while sleeping in bed. The blanket can include an elastic material on at least the underside corner edges thereof. Children and adults alike can stay warm at night as their blankets cannot fall away or off of them while sleeping. The fitted blanket may further include an opening and closing mechanism to allow for easy entry and exit, rather than having to untuck the blanket, as is the case with conventional blankets. The opening and closing mechanism may also provide an easy way to make the bed. The fitted nature of the blanket prevents blanket slippage or movement. The blanket may further include a cut-out region for pillow placement. The blanket can also include glow-in-the-dark elements or illuminated elements to light up the blanket at night.

12 Claims, 3 Drawing Sheets

FITTED BLANKET WITH OPENING AND CLOSING MECHANISM

CROSS-REFERENCE TO RELATED APPLICATION

This application claims the benefit of priority of U.S. provisional application No. 61/596,114, filed Feb. 7, 2012, the contents of which are herein incorporated by reference.

BACKGROUND OF THE INVENTION

The present invention relates to articles of bedding and, more particularly, to a fitted blanket with an opening and closing mechanism for child cribs, toddler beds, adult beds, hospital beds, and portable or inflatable mattresses.

Blankets, as currently marketed, are simply laid over the mattress or could be tucked under a mattress. Either way, these methods cannot assure the blanket will stay on the bed and on top of the user. There are currently no blankets on the market that prevent the blanket from coming untucked and loose, or from falling away from the user. There are also no blankets on the market that allow for easy access in order to easily get in or out of the bed.

Conventional blankets often move off a child or adult while sleeping in bed. In addition to not serving their function in covering up a person in bed, these blankets may fall away from the bed during the night, making it even more difficult to cover back up. Parents need to regularly pull up a blanket many times during the course of a night to keep a child covered.

As can be seen, there is a need for an improved blanket that may stay on the bed an in its proper position while providing a means of entry and exit from the bed.

SUMMARY OF THE INVENTION

In one aspect of the present invention, an article of bedding comprises a fitted bedding material adapted to fit on a mattress, the mattress having a head end and a foot end; a pillow cut-out at the head end of the bedding material, the pillow cut-out forming a region for a user's pillow when the fitted bedding material is disposed on the mattress; and a bedding connection disposed from the pillow cut-out, running towards the foot end of the bedding material.

In another aspect of the present invention, an article of bedding comprises a fitted bedding material adapted to fit on a mattress, the mattress having a head end and a foot end; an elastic band region running along at least a portion of an outer periphery of the fitted bedding material; a pillow cut-out at the head end of the bedding material, the pillow cut-out forming a region for a user's pillow when the fitted bedding material is disposed on the mattress; and a zipper disposed along a length of the fitted bedding material.

These and other features, aspects and advantages of the present invention will become better understood with reference to the following drawings, description and claims.

DETAILED DESCRIPTION OF THE INVENTION

Figure 1:
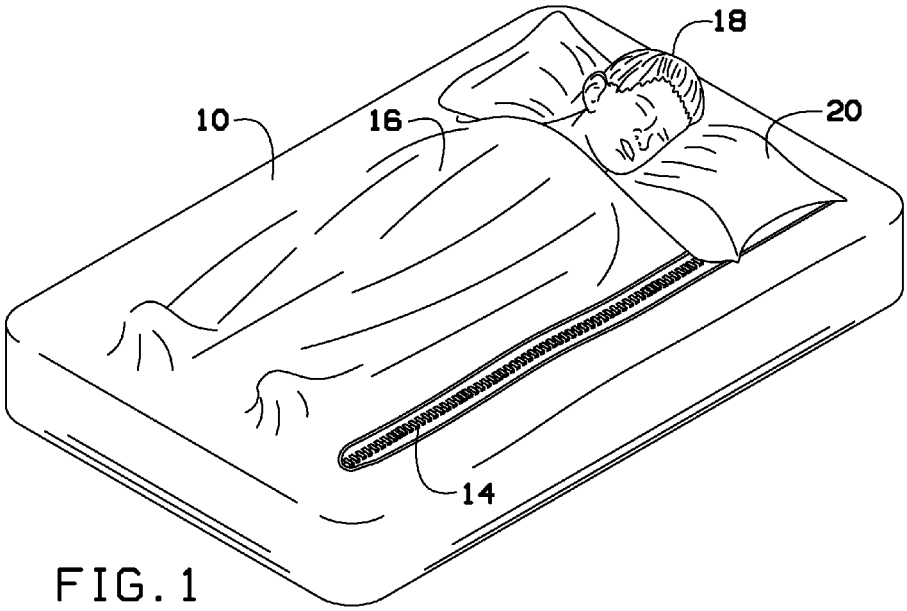
FIG. 1 is a perspective view of a fitted blanket, in use, according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a fitted blanket that fits over the mattress and secures underneath to prevent the blanket from moving off the user while sleeping in bed. The blanket can include an elastic material on at least the underside corner edges thereof to help secure the blanket to the mattress. Children and adults alike can stay warm at night as their blankets cannot fall away or off of them while sleeping. The fitted blanket may further include an opening and closing mechanism to allow for easy entry and exit, rather than having to untuck the blanket, as is the case with conventional blankets. The opening and closing mechanism may also provide an easy way to make the bed. The fitted nature of the blanket prevents blanket slippage or movement. The blanket may further include a cut-out region for pillow placement. The blanket can also include glow-in-the-dark elements or illuminated elements to light up the blanket at night.

Referring now to FIGS. 1 through 5, a fitted blanket 10 can be disposed over a mattress 24. The fitted blanket 10 may be similar to a conventional fitted sheet, including elastic 12 disposed about at least a portion of the underside edges of the fitted blanket 10, allowing the sides of the fitted blanket 10 to be resiliently disposed under the mattress 24.

On the top side of the mattress 24, the fitted blanket 10 may include a cut-out 22 for pillow placement. The cut-out 22 may be stitched or lined with piping, such as flat piping.

The fitted blanket 10 may include blanket connection 14 along one side of the fitted blanket 10, starting at the pillow cut-out 22 and running substantially parallel with the length of the mattress 24. When the blanket connection 14 is disconnected (as shown partially disconnected, or partially unzipped, as shown in FIG. 2), a flap 16 can be formed that can be folded down to allow a user 18 to get under the flap 16. When the blanket connection 14 is closed, the user can be disposed under the flap 16 and cannot roll out or kick off the blanket, as shown in FIG. 1.

The blanket connection 14 may run from about 50 to about 90 percent of the length of the fitted blanket 10 from the pillow cut-out 22. In some embodiments, the blanket connection 14 may run from the pillow cut-out 22 until reaching a point that is about 7 to 20 inches, typically about 9 inches, from the edge of the mattress 24 (when the fitted blanket 10 is fitted on the mattress 24). In some embodiments, the blanket connection 14 may not be connected with the pillow cut-out 22, but instead, may simply form an opening in the fitted blanket 10. The blanket connection 14 is typically a zippered opening. The zippered opening may allow easy entry and exit from the blanket, and also provide a quick way of making the bed. In some embodiments, other blanket connections may be used, such as snaps, buttons, hook and loop fasteners, or the like.

While the Figures show the blanket connection 14 running in an essentially linear manner from the pillow cut-out 22 toward the foot end of the mattress, the blanket connection 14 could be formed in various shapes. For example, the blanket connection 14 could run in a zig-zag or arcuate manner from the pillow cut-out 22 towards the foot end of the mattress. In some embodiments, the blanket connection 14 could extend generally parallel with the foot end of the mattress to create a flap 16 that is more rectangular than triangular (as shown in the Figures).

Figure 2:
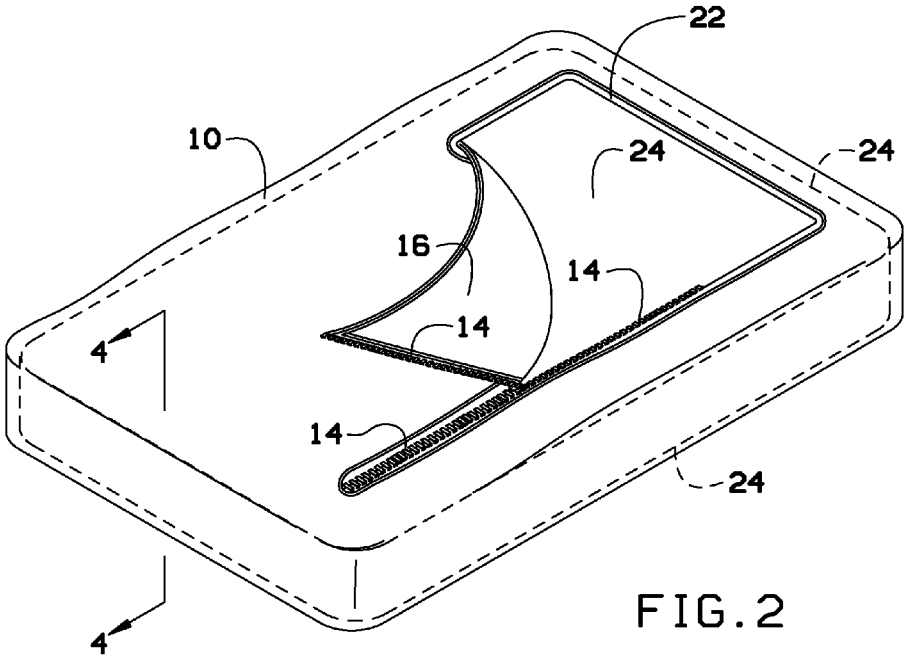
FIG. 2 is a perspective view of the fitted blanket of FIG. 1 illustrated installed and shown with its flap in a partial open configuration.
Figure 3:
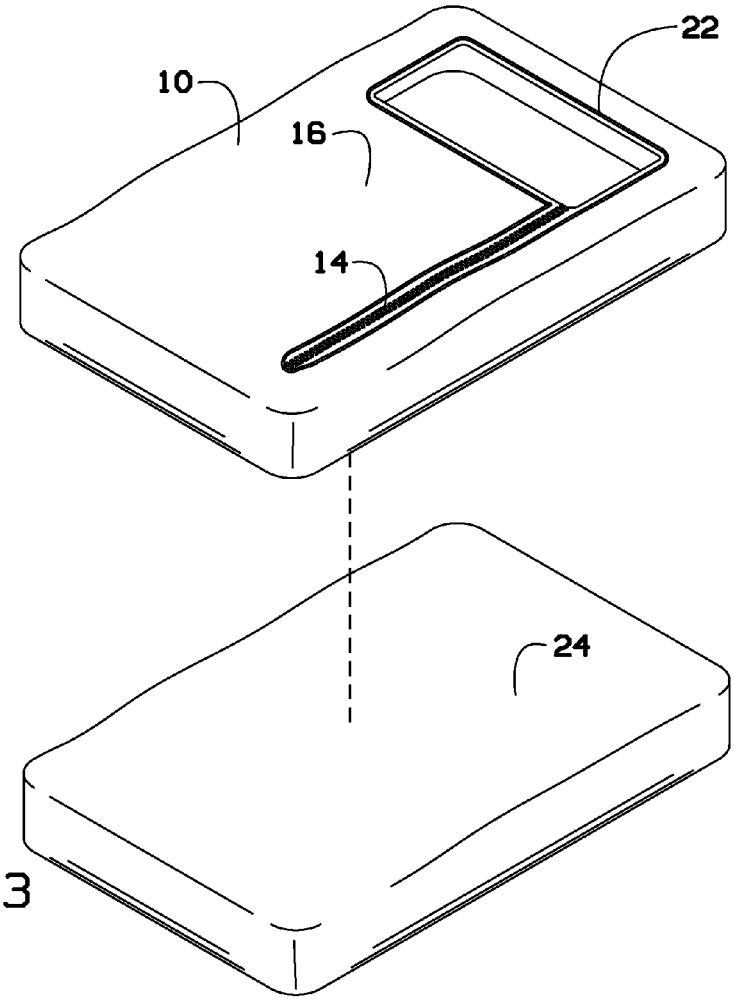
FIG. 3 is an exploded perspective view of the fitted blanket of FIG. 1 separated from the mattress.
Figure 4:
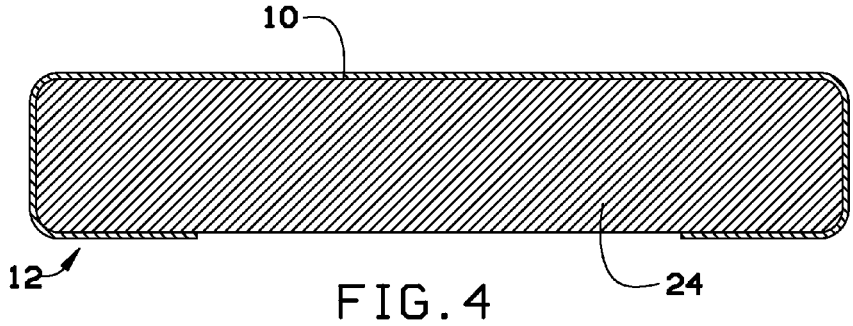
FIG. 4 is a cross-sectional view taken along line 4-4 of FIG. 2.

Typically, the blanket connection is disposed near one side of the blanket, as shown in FIGS. 1 through 3, but may also be disposed in a central region thereof. For larger blankets, for example, for king or queen sized beds, the blanket connection 14 may be disposed on each side of the fitted blanket 10, allowing two people to use the fitted blanket 10 and still allow for easy entry and exit. In some embodiments, the blanket connection 14 may run at an angle, for example, diagonally, down the fitted blanket 10 from the pillow cut-out area 22.

Figure 5:
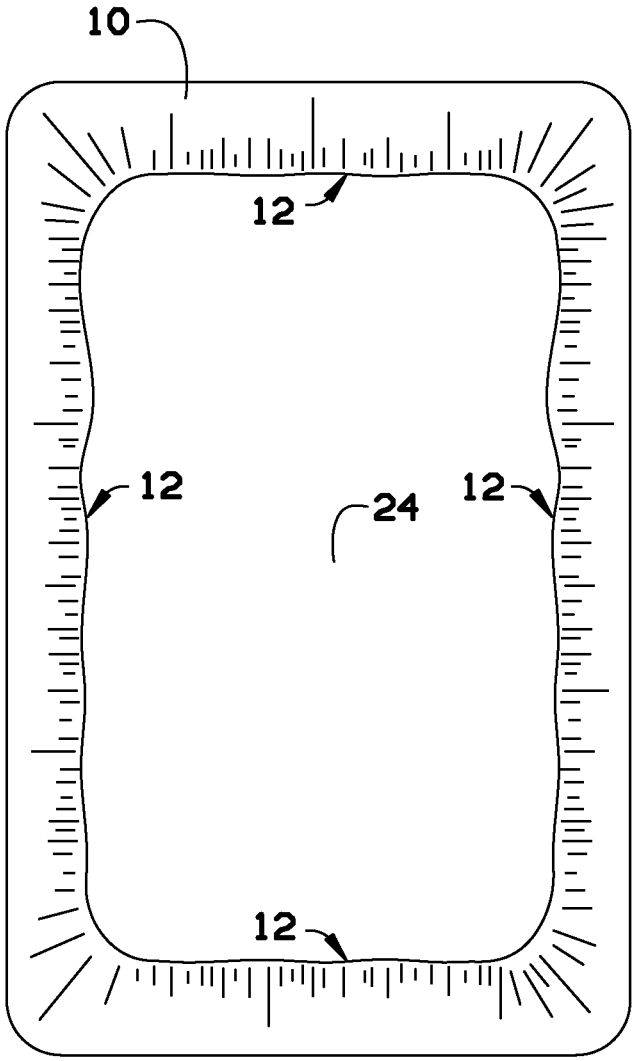
FIG. 5 is a bottom view of the fitted blanket of FIG. 1.

The fitted blanket 10 may be made from various fabrics, including, but not limited to cotton, silk, wool, polyester, synthetics and various blends. The fitted blanket 10 may also include an elastic, fitted underside as shown in FIG. 5. The elastic 12 can be disposed along the entire periphery of the fitted blanket 10, as shown in FIG. 5, or may be limited to corner regions of the fitted blanket 10 or the like.

The fitted blanket 10 may be designed as a blanket system, including multiple top covers. For example, the blanket system may include a fitted blanket, made of thin sheet material, such as cotton, and may further include a warmer blanket, such as a comforter, attachable thereto. Items or appendages may be attached or detached to the blanket via Velcro® or other similar securing mechanism. The blanket may be reversible and may also include accessories that may be attached to add additional appeal. Such accessories may include, for example, glow in the dark items, such as glow in the dark zippers, borders, or other accessories. The blanket could include illuminating features, such as lights (for example, light emitting diodes (LEDs)) disposed at various locations in the blanket. The blanket may be embossed with various logos, emblems or the like, such as superheroes, sports teams, cartoon characters, and the like.

The blanket may be placed on top of a conventional fitted sheet that is disposed on a mattress. In some embodiments the blanket of the present invention may be a multi-layer blanket, providing a fitted sheet built into the blanket, so that when a user enters the bedding, the user lies on top of the fitted sheet and covers up with a blanket. The fitted sheet portion may be attached to the fitted blanket by various methods. For example, the fitted sheet portion may be attached to the fitted blanket via a hook and loop fastener (such as Velcro®), stitching, zipper, snaps, or the like.

In some embodiments, the blanket may include heating or cooling elements that may be operable via conventional means, such as a battery, or a power source, such as standard household current. The heating or cooling mechanism may be used as desired for the comfort of the user.

To use the present invention, a user may simply apply the blanket to a mattress, similarly to how a fitted sheet is applied, with the pillow cut-out disposed at the head of the mattress. To enter the bed, a user may unzip (or disconnect the blanket connection), get under the blanket, and reattach the blanket connection. This now assures that the blanket will not come off the user if s/he rolls over or tries to kick off the blanket. To exit the bed, the blanket connection may be disconnected and the user may exit. Then, to make the bed, the user needs only to re-connect the blanket connection and the bed is made.

It should be understood, of course, that the foregoing relates to exemplary embodiments of the invention and that modifications may be made without departing from the spirit and scope of the invention as set forth in the following claims.

What is claimed is:

1. An article of bedding comprising:

a bedding material, having a head end and a foot end, and a first side and a second side that extend from the head end to the foot end, adapted to fit on a mattress, the mattress having an upward facing surface, the upward facing surface positioned upwards when the mattress is in an in-use position;

an opening, for placement of a pillow, formed in at least one layer of the bedding material, the opening disposed on an upward facing side of the article of bedding when the bedding material is disposed on the mattress and the opening disposed on the upward facing surface of the mattress, the opening having a first side, disposed toward the first side of the bedding material, and a second side, disposed toward the second side of the bedding material; and a bedding connection disposed from at least one of the first side and the second side of the opening, extending towards a foot end of the bedding material.

2. The article of bedding of claim 1, further comprising an elastic band region running along at least a portion of the bedding material to create a fitted bedding material.

3. The article of bedding of claim 1, wherein the bedding connection includes at least one of a zipper, snaps, buttons, and hook and loop fasteners.

4. The article of bedding of claim 1, wherein the bedding connection extends from about 50 to about 90 percent of a length of the bedding material.

5. The article of bedding of claim 1, wherein the bedding connection extends from the opening to a point that is about 7 to about 20 inches from the foot end of the mattress.

6. The article of bedding of claim 1, wherein the bedding connection runs in a zig-zag or arcuate manner from the opening toward the foot end of the mattress.

7. An article of bedding, in combination with a mattress, the article of bedding comprising:

a bedding material, having a head end and a foot end, adapted to fit on the mattress, the mattress having an upward facing surface, the upward facing surface positioned upwards when the mattress is in an in-use position;

an opening, for placement of a pillow, formed in at least one layer of the bedding material, the opening disposed on an upward facing side of the article of bedding when the bedding material is disposed on the mattress and the opening disposed on the upward facing surface of the mattress; and a bedding connection disposed from the opening, extending towards a foot end of the bedding material.

8. The article of bedding of claim 7, further comprising an elastic band region running along at least a portion of the bedding material to create a fitted bedding material.

9. The article of bedding of claim 7, wherein the bedding connection includes at least one of a zipper, snaps, buttons, and hook and loop fasteners.

10. The article of bedding of claim 7, wherein the bedding connection extends from the opening to a point that is about 7 to about 20 inches from the foot end of the mattress.

11. The article of bedding of claim 7, wherein the bedding connection is disposed on at least one of a first side, a second side or a central region of the bedding material.

12. The article of bedding of claim 7, wherein the bedding connection runs in a zig-zag or arcuate manner from the opening toward the foot end of the mattress.

* * * * *